US007828151B2

(12) United States Patent
Murdoch et al.

(10) Patent No.: US 7,828,151 B2
(45) Date of Patent: Nov. 9, 2010

(54) CORNER PROTECTOR

(75) Inventors: Thomas Murdoch, London (GB); Greg Gonzalez, London (GB)

(73) Assignee: Armored (UK) Limited (GB)

( * ) Notice: Subject to any disclaimer, the term of this patent is extended or adjusted under 35 U.S.C. 154(b) by 134 days.

(21) Appl. No.: 12/083,297

(22) PCT Filed: Oct. 12, 2006

(86) PCT No.: PCT/GB2006/003777

§ 371 (c)(1),
(2), (4) Date: Apr. 8, 2008

(87) PCT Pub. No.: WO2007/045822

PCT Pub. Date: Apr. 26, 2007

(65) Prior Publication Data

US 2009/0250367 A1 Oct. 8, 2009

(30) Foreign Application Priority Data

Oct. 15, 2005 (GB) ..... 0521002.6
Mar. 14, 2006 (GB) ..... 0605071.0

(51) Int. Cl.
*B65D 81/05* (2006.01)
*A47B 95/00* (2006.01)

(52) U.S. Cl. ..... 206/586; 206/453; 248/345.1

(58) Field of Classification Search ..... 206/453, 206/586, 597; 248/345.1; 108/27, 90; 49/462; D8/403

See application file for complete search history.

(56) References Cited

U.S. PATENT DOCUMENTS

D33,995 S * 1/1901 Munzesheimer ..... D8/403
1,690,824 A * 11/1928 Kondolf ..... 206/453
2,217,754 A * 10/1940 Johnson ..... 248/345.1
2,233,694 A * 3/1941 Cramer et al. ..... 248/345.1
2,995,863 A * 8/1961 Bright ..... 248/345.1
3,030,728 A * 4/1962 Wesman ..... 248/345.1
3,073,439 A * 1/1963 Symmonds, Jr. ..... 206/453

(Continued)

FOREIGN PATENT DOCUMENTS

DE 8700167 11/1988

(Continued)

OTHER PUBLICATIONS

International Search Report Mar. 1, 2007.

*Primary Examiner*—Bryon P Gehman
(74) *Attorney, Agent, or Firm*—Ira S. Dorman

(57) ABSTRACT

A corner protector, e.g. for a sheet of glass, has a pair of generally triangular side walls connected by a pair of substantially perpendicular bridging walls. The internal faces of the bridging walls are substantially flat and are separated by a recess. Internal channels are provided along the junction between the side walls and the bridging walls. The margins of the side walls which extend between the outer ends of the bridging walls are curved such that they are mutually offset from each other for most of their length. At least one of the side walls contains a through-aperture for receiving an adhesive pad which adheres to the protected article in use to hold the corner protector in place. A finger notch provides access to an edge of the adhesive pad to facilitate peeling in order to remove the corner protector.

3 Claims, 3 Drawing Sheets

U.S. PATENT DOCUMENTS

| | | | | | |
|---|---|---|---|---|---|
| 3,144,236 | A | * | 8/1964 | Clanin | 248/345.1 |
| D223,895 | S | * | 6/1972 | Berchert | D8/403 |
| 3,960,354 | A | * | 6/1976 | Simikoski | 248/345.1 |
| 4,202,449 | A | * | 5/1980 | Bendt | 206/453 |
| 4,242,848 | A | * | 1/1981 | Schoultz | 108/27 |
| 4,714,163 | A | * | 12/1987 | Reeves | 206/586 |
| 4,801,018 | A | * | 1/1989 | Wilde | 206/586 |
| 4,877,673 | A | * | 10/1989 | Eckel et al. | 206/453 |
| 5,149,575 | A | * | 9/1992 | Soifer | 248/345.1 |
| 7,311,958 | B2 | * | 12/2007 | Morris | 248/345.1 |
| 7,350,646 | B2 | * | 4/2008 | Durrant | 206/586 |
| 2005/0150810 | A1 | | 7/2005 | Durrant | |

FOREIGN PATENT DOCUMENTS

| | | | |
|---|---|---|---|
| EP | 0417487 | A1 * | 3/1991 |

* cited by examiner

CORNER PROTECTOR

TECHNICAL FIELD OF THE INVENTION

This invention relates to a corner protector which is principally intended for protecting the corners of sheets of glass during handling and transportation. However, the device can also be used to protect other easily damaged corners, e.g. of metal sheets, furniture, pictures, marble, masonry, etc. In addition to protecting the corner of an object the corner protector also reduces the risk of injuries caused by accidental contact with such corners. Furthermore, as will be explained below, the corner protector may also reduce the risk of damage to the regions between the protected corners.

BACKGROUND

Sheets of glass, for example, are frequently broken during transportation and handling. It has been observed that the weakest part of a sheet of glass is located very close to its corners, and more particularly at the junction between two substantially flat faces. Approximately 75% of all breakages during handling are caused by direct contact between a corner and another hard object. Such contact may cause the whole sheet to shatter, resulting in a risk of serious injury to the handlers.

Many other breakages result from contact between a bottom edge of a sheet of brittle material, such as a sheet of glass or marble, and a hard object, and for this reason it is necessary to carefully inspect and prepare any surfaces on which the sheet is to be stood. For example, if the sheet is inadvertently placed on a screw, nail or small stone during transportation in a motor vehicle the sheet will often be damaged, requiring the whole sheet to be scrapped.

The present invention seeks to provide a new and inventive form of corner protector which substantially reduces the risk of damage to a protected object, and is easy to apply and remove yet remains in place for as long as required.

SUMMARY OF THE INVENTION

The present invention proposes a corner protector which includes a pair of side walls connected by a pair of substantially perpendicular bridging walls.

The internal faces of the bridging walls are preferably substantially flat and are preferably separated by a recess. Such a recess significantly reduces the risk that any impacts received by the corner protector will be transmitted to the junction between perpendicular edge faces of a protected article. Internal channels are preferably provided along the junction between the side walls and the bridging walls, which reduces stresses at the junction between the side and edge faces of a protected article during impacts with the corner protector.

Preferably the margins of the side walls which extend between the outer ends of the bridging walls are mutually offset from each other for most of their length and are preferably curved. This reduces the risk that the corner of an article enclosed within the corner protector will break off when the corner protector is subjected to lateral impacts.

Preferably at least one of the side walls contains an aperture for receiving an adhesive pad which adheres to the protected article in use to hold the corner protector in place. The aperture preferably extends through the side wall so that the adhesive pad can be inserted through the aperture after the corner protector is in position. The aperture preferably has a finger notch providing access to an edge of the adhesive pad to facilitate peeling the pad off the protected article in order to remove the corner protector. To further reduce stresses transmitted to the corner region of the protected article the edges of the side walls which are joined by the bridging walls are preferably curved at one or both ends.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
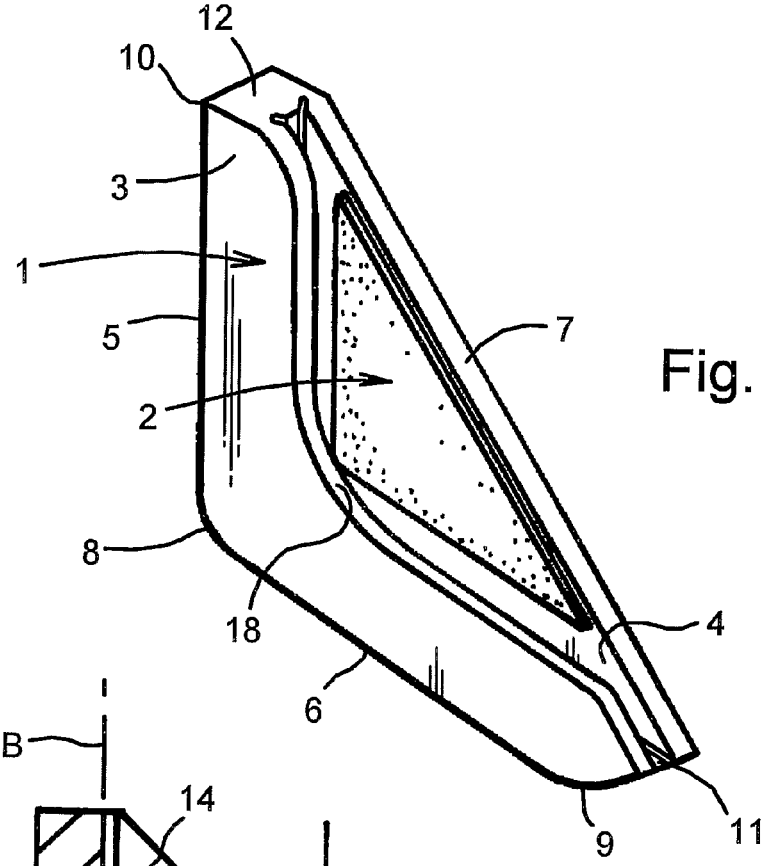
FIG. 1 is a general external view of a corner protector in accordance with the invention.

The corner protector which is shown by way of example in FIG. 1 is intended to protect the corner of a sheet of glass or similar material. The corner protector comprises an injection moulded plastic component 1 and an adhesive pad 2.

The plastic component 1 has two substantially parallel side walls 3 and 4 connected by a pair of mutually perpendicular bridging walls 11 and 12. The side walls 3 and 4 are of generally triangular outline, having a pair of mutually perpendicular edges 5 and 6 and an inclined edge 7. The junction region 8 between the perpendicular edges 5 and 6 is preferably curved to form smooth transition between the two edges. Each of the perpendicular edges 5 and 6 may also be curved towards the inclined edge 7, as shown in relation to the curved region 9. However, one or both of the perpendicular edges 5, 6 may form an angular transition with the inclined edge 7, as shown at 10.

Figure 2:
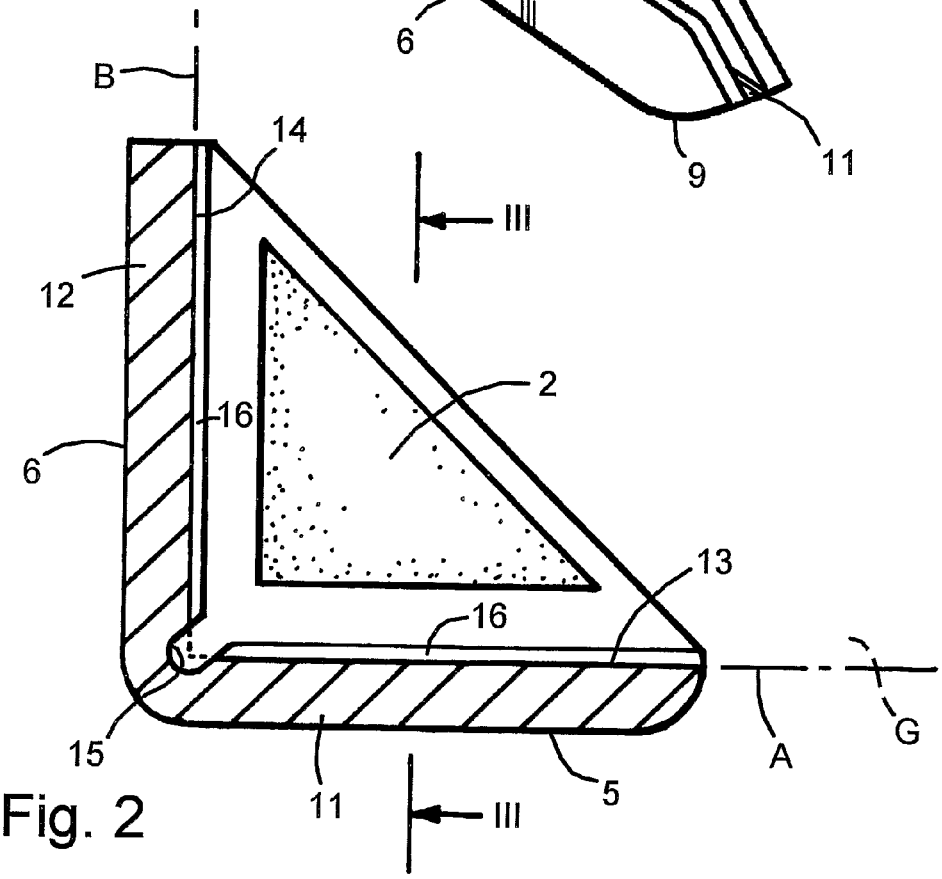
FIG. 2 is a sectional view of the corner protector as applied to a sheet of glass, generally in the plane of the sheet.

Referring to the sectional view of FIG. 2, the bridging walls 11 and 12 extend between the perpendicular edges of 5 and 6 of the side walls 3 and 4.

The internal faces 13 and 14 of the two bridging walls are substantially planar and mutually perpendicular. However, where the two walls meet, the internal faces of the bridging walls are formed with an internal recess 15 extending between the side walls 3 and 4. Furthermore, the internal faces of the side walls 3 and 4 are both formed with channels 16 extending along the junction with the bridging walls 11 and 12.

Figure 3:
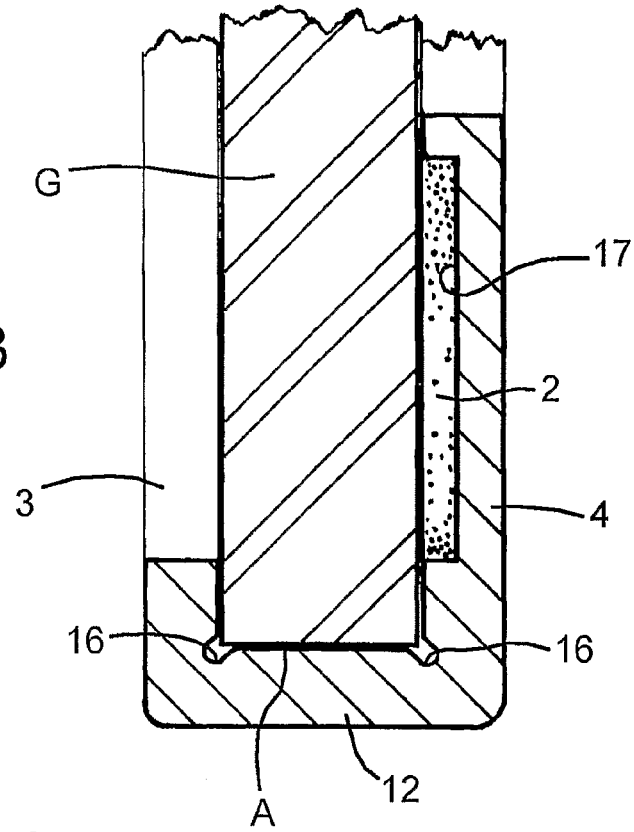
FIG. 3 is a further sectional view of the corner protector, perpendicular to its plane, on the line III-III of FIG. 2.

The adhesive pad 2 may be formed of or coated with a known contact adhesive and is of a spongy resilient nature. The pad is generally triangular, being inset into a shallow, co-operatively shaped recess 17 in one of the side walls 4, as shown in FIG. 3. Prior to use, the exposed surface of the adhesive pad is slightly proud of the recess. The inclined edge 7 of the opposing side wall 3 is preferably formed with a notch 18 (FIG. 1) which generally conforms to the size and shape of the adhesive pad 2. This notch facilitates application of the adhesive pad during manufacture or the corner protector, and may also allow a protective peel-off sheet applied to the adhesive pad to be easily removed prior to use.

In order to protect a rectangular sheet of glass of an appropriate thickness, for example, one of the corner protectors described above is applied to each of its four corners. After removing any peel-off sheet from the adhesive pad the corner protector is slid onto the sheet G, shown in FIGS. 2 and 3, in a direction parallel to the plane of the sheet, until the internal faces 13 and 14 make contact with the adjacent straight edges A and B of the sheet. During such sliding movement the resilient pad 2 is compressed into recess 17 so that adhesion does not occur until the protector is in place, when the period of contact is sufficient for a stronger adhesive bond to develop. It will be noted that although the corner protector is firmly located by the bridging walls 11 and 12 there is no contact between the corner protector and the corner region of the sheet where the edges A and B meet. Contact is also reduced along the margins of the edges A and B by means of the channels 16. Any shocks caused by contact between the corner protector and another object will thus be distributed across an area of the edges A and B.

The corner protector reduces the risk of injury which might be caused by contact with the protected corner. The curved external surfaces 8 and 9 of the corner protector provide ease of movement when stacking the sheets and reduces the risk of the corner protectors being knocked off. Furthermore, if the sheet is stood on a flat surface its bottom edge B will be raised clear of the surface by the corner protectors, reducing the risk of damage to the bottom edge of the sheet.

The corner protectors can be removed by application of pressure parallel to one of the edges A and B sufficient to overcome the adhesive bond. The angular region 10 facilitates removal of the corner protector when required, e.g. by application of pressure by means of a boot or shoe.

Figure 4:
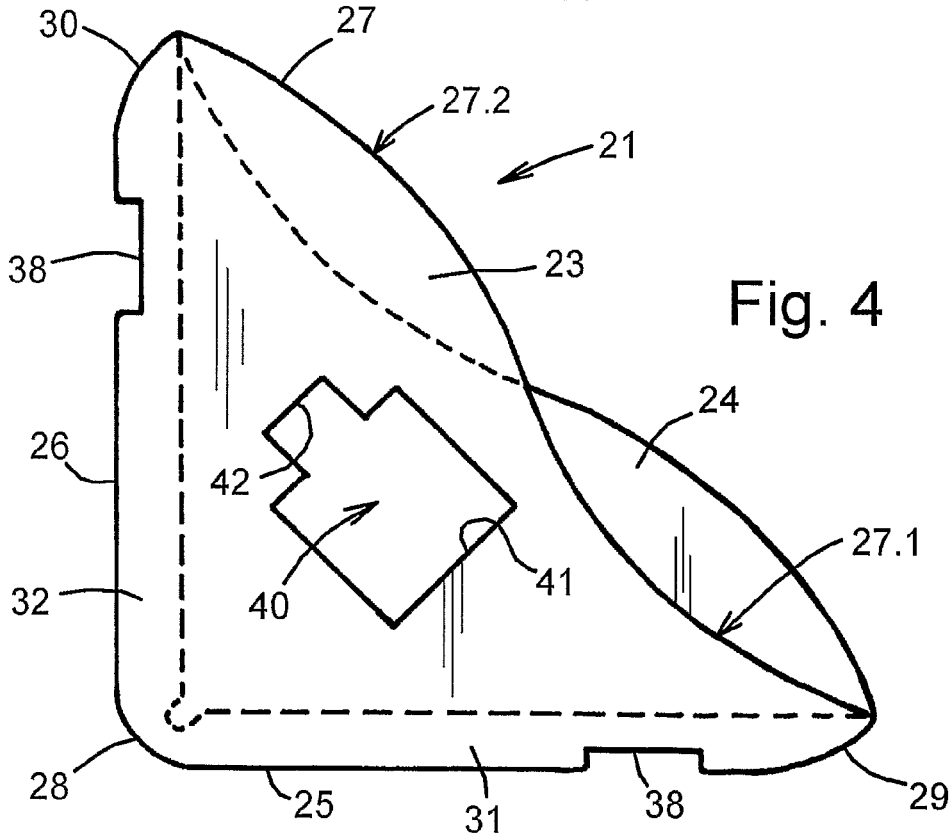
FIG. 4 is a side view of a modified form of corner protector in accordance with the invention.
Figure 5:
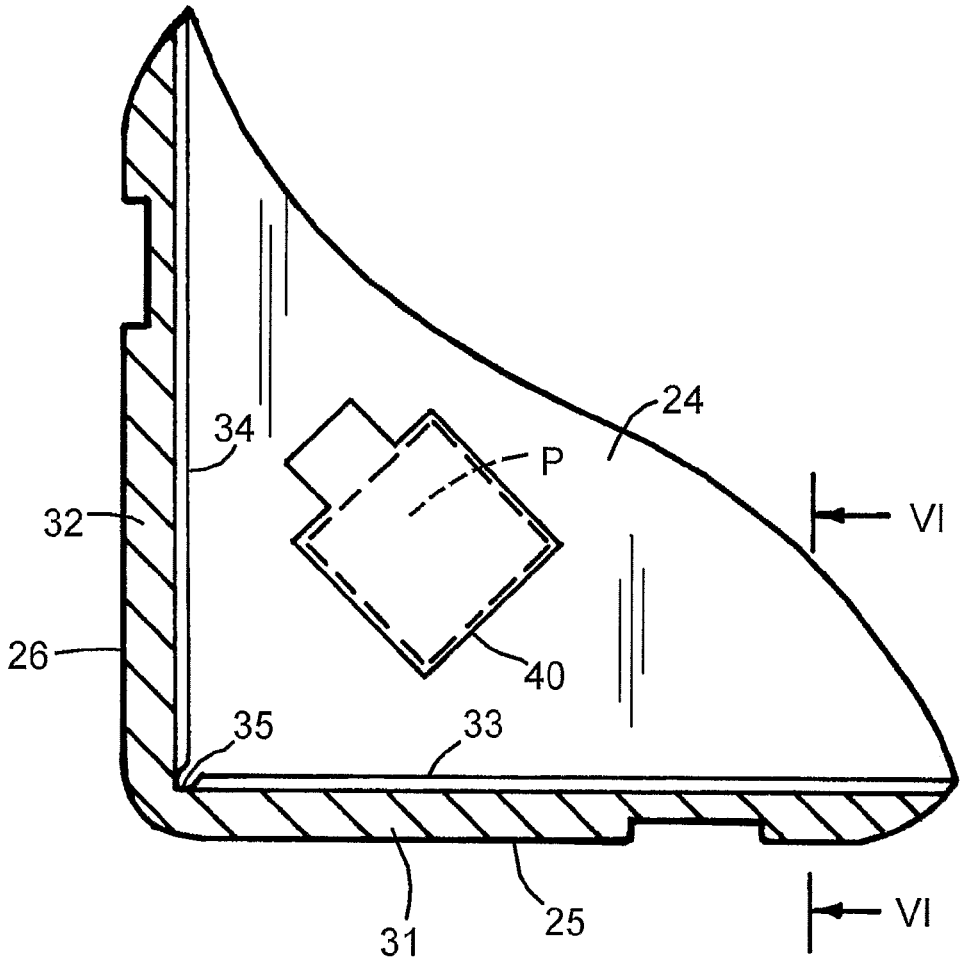
FIG. 5 is a sectional view of the modified corner protector between its side walls.
Figure 6:
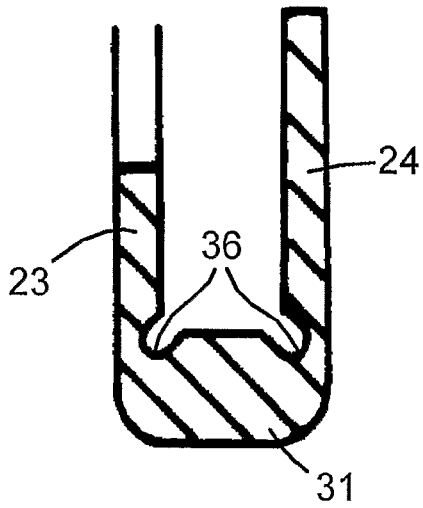
FIG. 6 is a further sectional view of the corner protector on plane VI-VI of FIG. 5.

The modified corner protector which is shown in FIGS. 4 to 6 is somewhat easier to fit onto a sheet of glass, may be attached more securely, and ensures that the strength of the corner protector is not compromised by the notch 18. Considering FIG. 4, the corner protector comprises an injection moulded plastic component 21 having two substantially parallel side walls 23 and 24 connected by a pair of mutually perpendicular bridging walls 31 and 32. The side walls 23 and 24 are both of generally triangular shape, having a pair of mutually perpendicular edges 25 and 26 joined by a third edge 27 which is formed with a concave portion 27.1 and a convex portion 27.2. The concave and convex portions are transposed on the opposing side wall so that a concave portions 27.1 both lie opposite a convex portion 27.2. This arrangement ensures that when the corner protector is affixed to a sheet of glass as described below, forces are distributed over an area of the glass instead of being applied in a straight line across the corner, substantially reducing the risk of the corner being broken off. The junction between the perpendicular edges 25 and 26 is curved at 28, and the opposite end of each perpendicular edge is curved at 29 and 30 to meet the edge 27. However, one or both of the perpendicular edges 25 and 26 may, instead, form an angular transition with the edge 27. The two side walls 23 and 24 are both formed with aligned through-apertures 40. The apertures are substantially T-shaped with a rectangular main part 41 and a smaller finger notch 42. The main part 41 is shaped to receive an adhesively-coated pad of cork or other soft resilient material, which may have a protective peel-off sheet applied to the adhesive layer prior to use.

Referring to FIG. 5, the bridging walls 31 and 32 extend between the perpendicular edges of 25 and 26 of the side walls 23 and 24. The internal faces 33 and 34 of the two bridging walls are substantially planar and mutually perpendicular, and are formed with an internal recess 35 where the two walls meet. Internal channels 36 extend along the junction between the side walls 23 and 24 and the bridging walls 21 and 22, as shown in FIG. 6.

The external faces of the bridging walls 31 and 32 may be provided with shallow flat-bottomed recesses 38, indicated in FIG. 4, which extend transversely across the respective bridging walls. These recesses are provided to locate strapping bands which are often placed around sheets of glass in transit.

To protect a sheet of glass of an appropriate thickness, for example, one of the corner protectors is applied to each of its four corners. After sliding the corner protector onto the glass until the internal faces 33 and 34 make contact with the adjacent straight edges of the glass sheet an adhesive pad P is inserted through one or both of the apertures 40 (see FIG. 5) and stuck to the glass to hold the corner protector in position.

The corner protectors reduce risk of injury and protect the corners of the sheet. The recess 35 ensures that there is no contact with the corner region of the sheet while the channels 36 ensure reduced contact along the sheet edges. Any shocks to the corner protector are therefore distributed across the faces of the glass sheet away from its vulnerable edges.

The corner protectors can easily be removed by peeling the adhesive pads away from the sheet, using the notches 42 for finger access to the edge of the pads.

The corner protectors described herein can be manufactured in various widths in order to protect sheets of various thickness.

It will be appreciated that the features disclosed herein may be present in any feasible combination. Whilst the above description emphasises those areas which, in combination, are believed to be new, protection is claimed for any inventive combination of the features disclosed herein.

The invention claimed is:

1. A corner protector applied to the corner of an article, said corner protector including a pair of side walls (23, 24) connected by a pair of substantially perpendicular bridging walls (31, 32) and at least one of the side walls containing an aperture (40) which extends through the at least one side wall, in which the aperture (40) receives an adhesive pad (P) of resilient material provided with an adhesive coat which adheres to the article to hold the corner protector in place, said aperture being substantially T-shaped and comprising a substantially rectangular main part and a smaller finger notch (42), and being shaped to contain said adhesive pad wholly within said rectangular main part of said aperture.

2. A corner protector including a pair of side walls connected by a pair of substantially perpendicular bridging walls, in which the side walls each have a curved edge which extends between the outer ends of the bridging walls and are each formed with a concave portion (27.1) and a convex portion (27.2), the curved edge of one of said side walls being reversed relative to the curved edge of the other of said side walls such that the two edges cross part way along their length and are mutually offset from each other, and such that the concave portion of each of said edges lies opposite a convex portion of the other of said edges.

3. A corner protector according to claim 2 in which at least one of the side walls contains an aperture for receiving an adhesive pad which adheres to the protected article in use to hold the corner protector in place.

* * * * *